US005892217A

United States Patent [19]

Pollin

[11] Patent Number: 5,892,217

[45] Date of Patent: Apr. 6, 1999

[54] LOCK AND SLIDE MECHANISM FOR TUBE LAUNCHED PROJECTILES

[76] Inventor: Irvin Pollin, 6600 Michaels Dr., Bethesda, Md. 20817

[21] Appl. No.: 985,292

[22] Filed: Dec. 4, 1997

Related U.S. Application Data

[60] Provisional application No. 60/053,401 Jul. 22, 1997.

[51] Int. Cl. [6] ..... F42B 10/00

[52] U.S. Cl. ..... 244/3.3; 244/3.24; 102/439

[58] Field of Search ..... 102/439, 517, 102/373, 372; 244/3.3, 3.24, 3.26

[56] References Cited

U.S. PATENT DOCUMENTS

| | | | |
|---|---|---|---|
| 46,490 | 2/1865 | Orwig | 244/3.3 |
| 656,933 | 8/1900 | Brown | 244/3.3 |
| 656,934 | 8/1900 | Brown . | |
| 1,278,786 | 9/1918 | Teleszky | 244/3.3 |
| 1,417,460 | 5/1922 | Driggs, Jr. | 102/439 |
| 2,437,211 | 3/1948 | Schermuly et al. . | |
| 3,007,410 | 11/1961 | Blacker | 244/3.3 |
| 3,086,467 | 4/1963 | Gallagher et al. . | |
| 3,125,957 | 3/1964 | Lipinski . | |
| 3,292,879 | 12/1966 | Chilowsky | 244/3.3 |
| 3,677,179 | 7/1972 | Potteiger et al. . | |
| 4,489,949 | 12/1984 | Taylor et al. . | |
| 4,541,342 | 9/1985 | Routledge . | |
| 4,572,463 | 2/1986 | Ashkenazi . | |
| 4,624,187 | 11/1986 | Bocker et al. | 102/517 |
| 4,674,706 | 6/1987 | Hall | 244/3.3 |
| 4,964,341 | 10/1990 | Hebert . | |

FOREIGN PATENT DOCUMENTS

| | | | |
|---|---|---|---|
| 3904625 | 8/1990 | Germany | 102/518 |
| 2257238 | 1/1993 | United Kingdom | 102/517 |

OTHER PUBLICATIONS

Translation of French Patent Application 2,535,450, filed Dec. 1987.

*Primary Examiner*—Charles T. Jordan
*Assistant Examiner*—Theresa M. Wesson

[57] ABSTRACT

A tube launched projectile having a shaft member at the aft section is slidably mounted on a boom extending aft from the body of the projectile. The boom has a cavity in its aft end which receives some combustion gas from the projectile propellant burn and retains this gas at elevated pressure until the projectile exits the tube. Upon reaching atmospheric pressure, the stored cavity gas expands and drives the slidable shaft aft, elongating the projectile to its flight configuration.

16 Claims, 7 Drawing Sheets

LOCK AND SLIDE MECHANISM FOR TUBE LAUNCHED PROJECTILES

CROSS REFERENCE TO PROVISIONAL APPLICATION

This application claims the benefit of U.S. provisional application No. 60/053,401, filed Jul. 22, 1997. The disclosure of which is hereby incorporated herein by reference.

BACKGROUND OF THE INVENTION

This invention relates in general to tube launched projectiles and in particular to tube launched projectiles which are fin stabilized or spin stabilized, where means are provided to elongate the projectile body when the projectile exits the launch tube.

Reduced length projectiles allow for reduced cost of transport and for increased launch tube propellant charge. In the case of fin stabilized projectiles the center of pressure of the fins can be relatively close to the projectile center of gravity. This configuration requires the fins be larger than for an elongated projectile to provide a restoring moment for control of the flight of the projectile. Since projectile fins typically contribute 30% to 50% of the total projectile aerodynamic drag, reductions in projectile drag would be desirable.

SUMMARY OF THE INVENTION

The present invention overcomes the disadvantages of fixed length projectiles detailed above by mounting the empennage or tail section on a hollow shaft which surrounds a portion of the projectile boom extending from the projectile body. The shaft is caused to slide along the boom in a constrained manner. The shaft is provided with axially extending splines spaced around its circumference which are assembled into matching grooves extending along the length of the boom. Thus, the projectile is assembled initially with the shaft in the most forward position. Means are provided for retaining the shaft in the forward position until the projectile exits the launch tube. The shaft is caused to slide to a rear, in-flight position after exiting the launch tube and is locked in the flight position during flight. The mechanism for extending the projectile to its flight length configuration utilizes the high pressure gas from the burning propellant to initially lock the shaft and boom in the pre-flight position during transit in the tube and to cause the shaft to slide to the flight position after exiting the launch tube. As an alternate or additional embodiment, a separate solid propellant or compressed gas cylinder may be provided in the projectile boom to cause the shaft to slide to the flight position.

A 10% to 25% reduction of projectile aerodynamic drag can be realized by the present invention whereby the projectile body elongates when the projectile has cleared the launching tube. This elongation occurs by causing the empennage containing the fin structure to slide rearward to a new flight position, effectively moving the fins rearward and achieving the advantages discussed above. Similarly, the rearward movement of the tail section and the accompanying shape change allows for significant changes in the stability characteristics and reduction of aerodynamic drag of spin-stabilized projectiles.

This invention is applicable for fin- and spin-stabilized tube launched projectiles. The empennage comprised of fins (fin-stabilized) or the aft body without fins (spin-stabilized) is mounted on a hollow shaft and at atmospheric ambient pressure is free to slide on a matching boom attached to the aft end of the projectile. At atmospheric ambient pressure, a small clearance between shaft and boom, say 0.001 inch, allows the shaft to move freely relative to the boom. Rotation between the shaft and boom is prevented by the following construction: Axially extending slots or grooves provided in the boom, along with axially extending splines provided in the forward end of the shaft allow for the axial sliding of the shaft relative to the boom without rotation.

The shaft deflects onto the boom and the two surfaces mechanically "lock" onto one another at the high tube pressures accompanying propellant ignition, whereupon the shaft moves with the boom inside the tube. This "locking" is attained on deflection by providing each surface with intermeshing ridges running orthogonal to the projectile axis, and/or by matching engaging teeth, and/or the like, and/or by providing a high friction coefficient between the two surfaces. Thus, at the high tube pressures, the mechanical "lock" is comprised of either of one or of a combination of intermeshing surfaces and friction shear stresses between the inner shaft and outer boom surfaces. Hence, following ignition of the projectile propellant, except possibly for an initial small insignificant movement until the tube pressure becomes sufficiently large, the shaft is "locked" onto and moves with the boom during the projectile transit in the tube.

An orifice at the base of the shaft serves as the opening to a small cavity within the boom. Propellant gases enter the cavity and the cavity pressure rises as a consequence of the high tube pressures during the transit of the projectile in the tube. Upon the projectile exiting the tube and the accompanying reduction of ambient pressure, the shaft deflects away from the boom so that the shaft "unlocks" and is again free to move relative to the boom. Furthermore, the high pressure of the gas trapped in the cavity relative to that of the ambient atmosphere acts on the vertical end wall of the shaft producing a rearward movement of the shaft relative to the boom and thereby a lengthening of the projectile. The shaft slides along the boom and the projectile continues to lengthen until the splines in the shaft reach a taper lock in the boom, where it becomes jammed and locked into place on the boom. The time required for the shaft deployment depends in part on the cavity volume, orifice diameter, and deployment length. The shaft deployment and thereby the projectile length can be increased by several calibers within a short distance of the tube exit.

DETAILED DESCRIPTION OF THE PREFERRED EMBODIMENT

Figure 1:
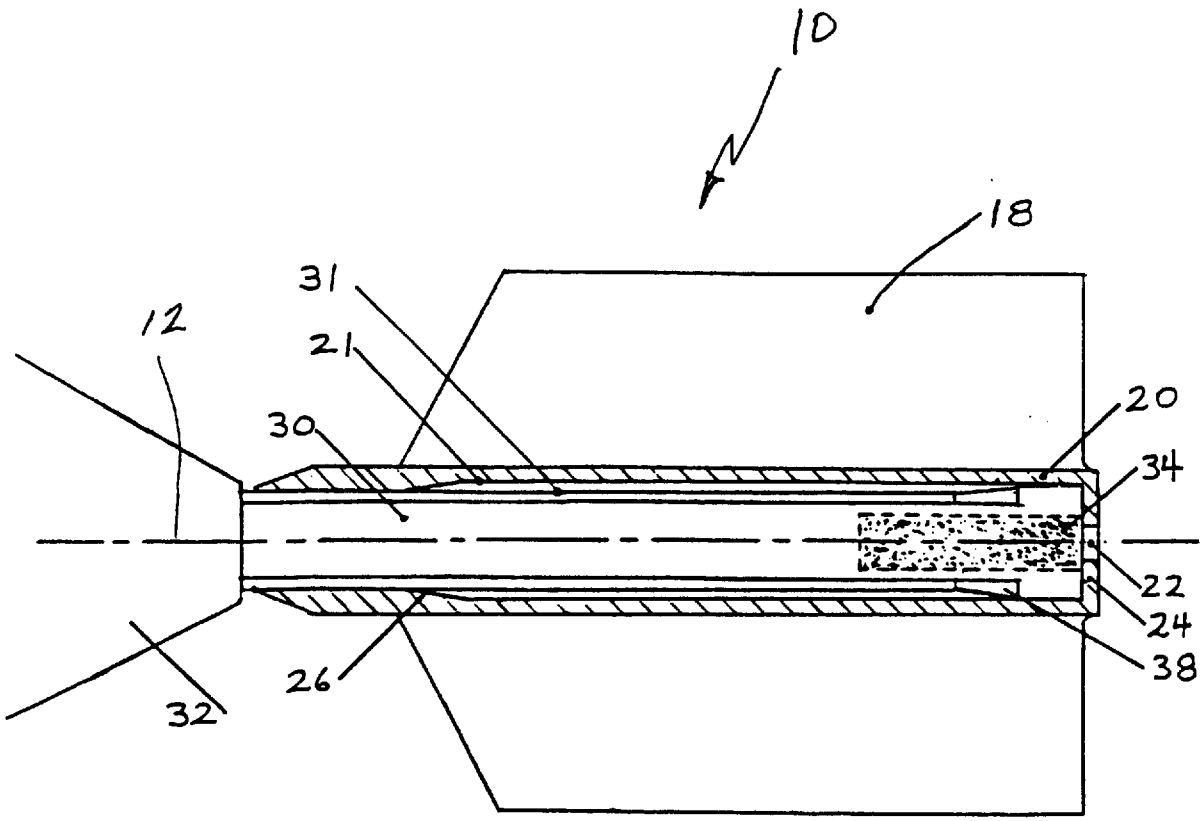
FIG. 1 is a partial longitudinal sectional view of the projectile in the pre-launch condition.

Referring now to FIG. 1, the projectile is shown generally at 10. For a fin-stabilized projectile, FIG. 1 illustrates an empennage 18 mounted on a slidable hollow shaft 20 and a fixed boom 30 extending from a projectile body 32 as it would appear in the launch tube under atmospheric pressure, prior to propellant ignition and prior to elongation. The projectile body 32 has a payload at its fore end (not shown). The projectile body 32 also defines a longitudinal axis 12. FIG. 1 also shows the intermeshing ridges, engaging teeth, and/or the like, and/or friction "locking" surfaces 21 and 31 of the shaft 20 and boom 30, a cavity 34 at the end of the boom 30, and an orifice 22 in a vertical end wall 24 of the shaft 20.

Figure 2:
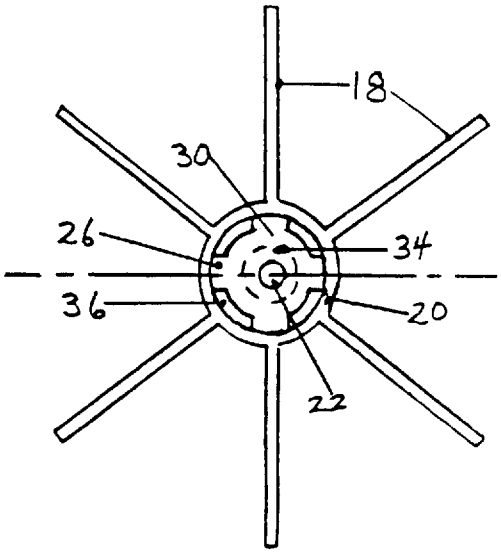
FIG. 2 is a cross sectional end view of the projectile.

For a fin-stabilized projectile, FIG. 2 illustrates splines 26 in the shaft 20 that ride slots or grooves 36 in the boom 30 that prevent rotation of the shaft 20 relative to the boom 30. For the purpose of illustration, four splines 26 and four slots or grooves 36 are shown, each subtending an angle of approximately 45°.

Figure 3:
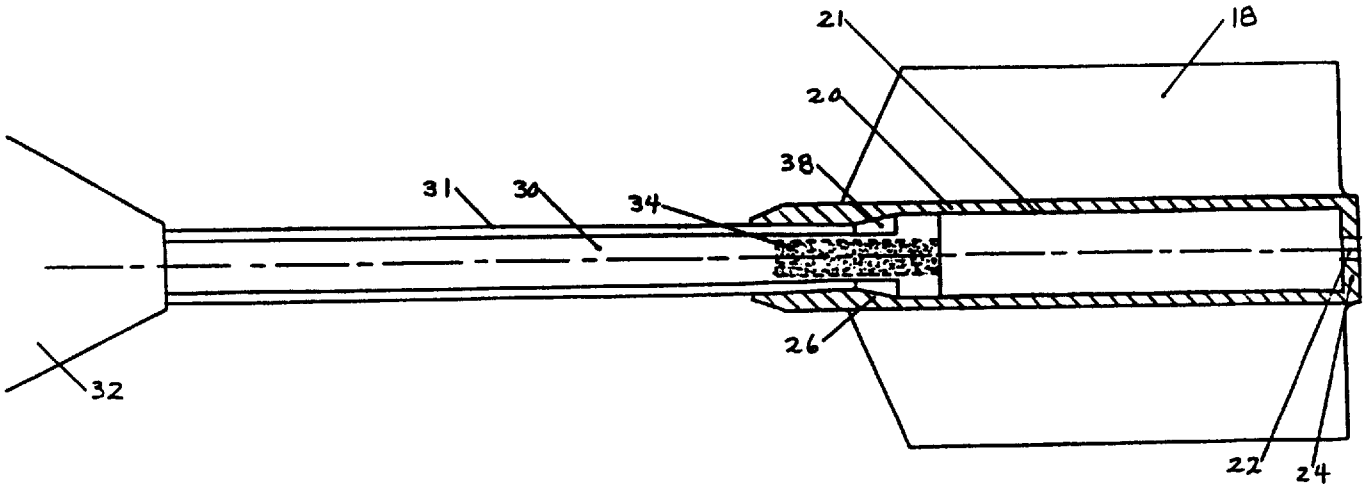
FIG. 3 is a partial longitudinal sectional view of the projectile in the flight condition.

For a fin-stabilized projectile, FIG. 3 illustrates the empennage 18 and slidable hollow shaft 20 and fixed boom 30 in its fully elongated form as it would appear shortly after exiting the launch tube. Upon full extension of the shaft 20, the splines 26 engage taper lock 38 in the boom 30, whereupon relative motion ceases between the shaft 20 and the boom 30.

In some instances it may be preferred to augment or insure development of the high pressure of the gas in the cavity by such means as igniting a small piece of propellant within the cavity or by releasing a compressed gas cartridge approximately simultaneously with ignition of the propellant driving the projectile in the launch tube.

Figure 4A:
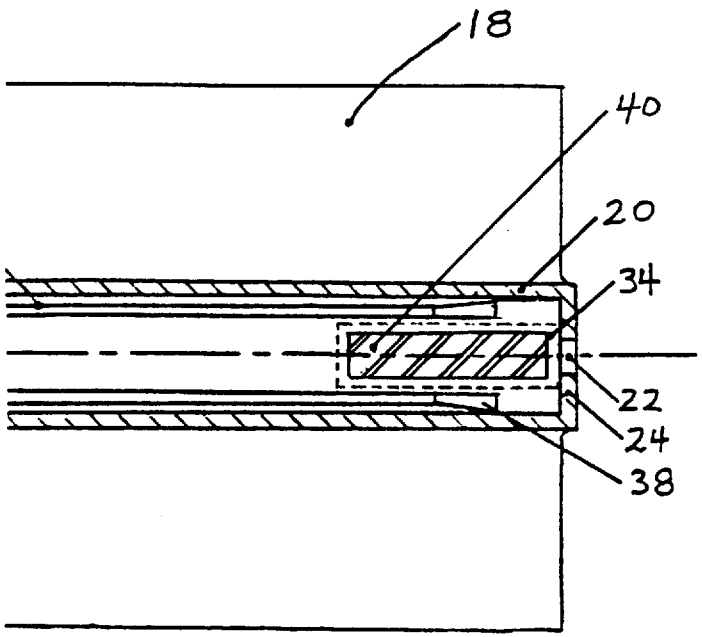
FIG. 4A is a partial longitudinal view of another embodiment of the projectile having a solid propellant assembled in the boom cavity.
Figure 4B:
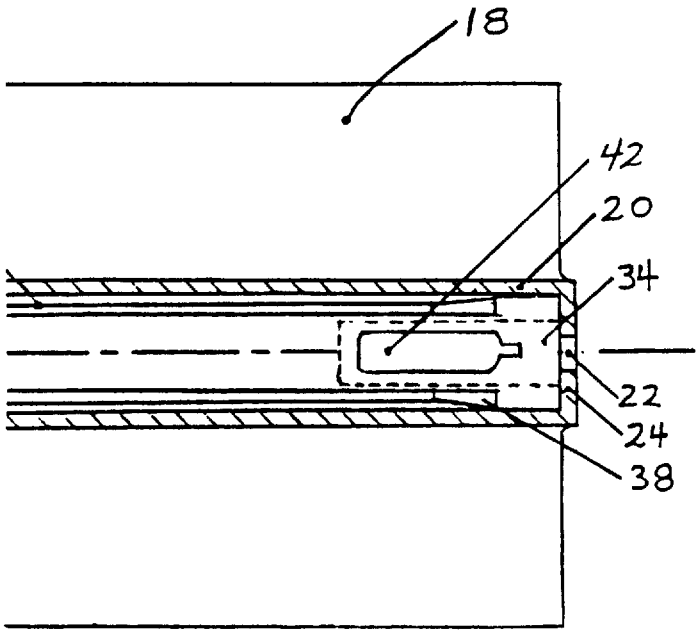
FIG. 4B is a partial longitudinal view of another embodiment of the projectile having a compressed gas cylinder assembled in the boom cavity.

FIG. 4A is a partial longitudinal view of the projectile having a piece of solid propellant 40 assembled in the boom cavity 34. FIG. 4B is a partial longitudinal view of the projectile having a compressed gas capsule or cylinder 42 assembled in the boom cavity 34.

Figure 5:
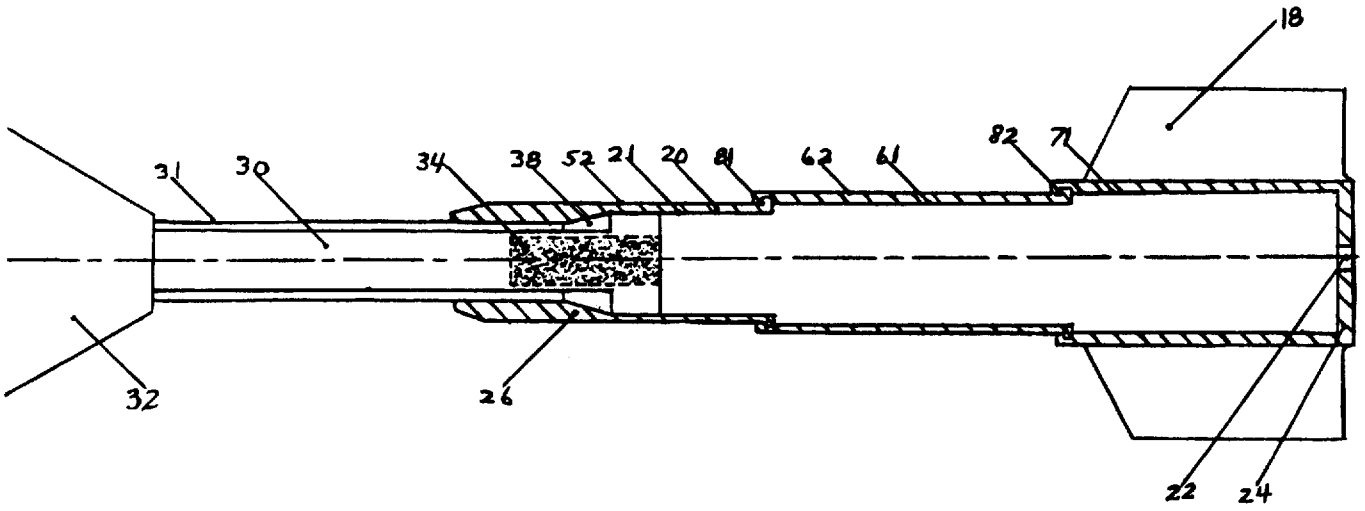
FIG. 5 is a partial longitudinal sectional view of the projectile in the flight condition having a hollow shaft comprised of telescoping-link sections.

For very long deployment distances of the shaft relative to the boom, the shaft can be comprised of unfolding telescoping links, like that of an antenna. For a fin-stabilized projectile, FIG. 5 illustrates the elongated projectile in its flight configuration when the hollow shaft is comprised of 3 telescoping sections. Here, the "locking" surfaces 21 of the most forward section of the hollow shaft 20 and 31 of the boom are the same as that for the single-section hollow shaft shown in FIG. 1. Moreover, the previously described intermeshing surfaces comprised of intermeshing ridges, engaging teeth, and/or the like, and/or friction "locking" surfaces are provided to mechanically "lock" the 3 sections of the shaft onto each other during the projectile transit in the tube in the same way as the single-section hollow shaft is "locked" onto the boom. Thus, the 3 sections of the hollow shaft 20 are fully folded over one another and over the boom 30 during the projectile transit in the tube. Referring to FIG. 5, the outer surface 52 of the most forward section is "locked" onto the inner surface 61 of the middle section; the outer surface 62 of the middle section is "locked" onto the inner surface 71 of the most aft section. For structural integrity and to arrest deployment, the joint connections 81 and 82 at each end of the middle section can be comprised of taper-lock jam devices, like that previously described between the hollow shaft and boom for the single-unit hollow shaft. The mechanical "lock" release and the boom cavity gas forced deployment of the sectioned hollow shaft on exciting the tube is the same as that for the previously described single-unit hollow shaft. The acceleration-time deployment of the shaft sections can be controlled by providing for and adjusting the sliding friction between the component shaft sections and boom, by adjustment of the boom cavity volume and shaft orifice area opening, and by use of a ball check valve.

Spin-stabilized projectiles can be illustrated as in the above figures, except for the absence of fins. Here, only the hollow shaft is deployed and its geometry can be contoured to provide an extended "boattail".

Figure 6:
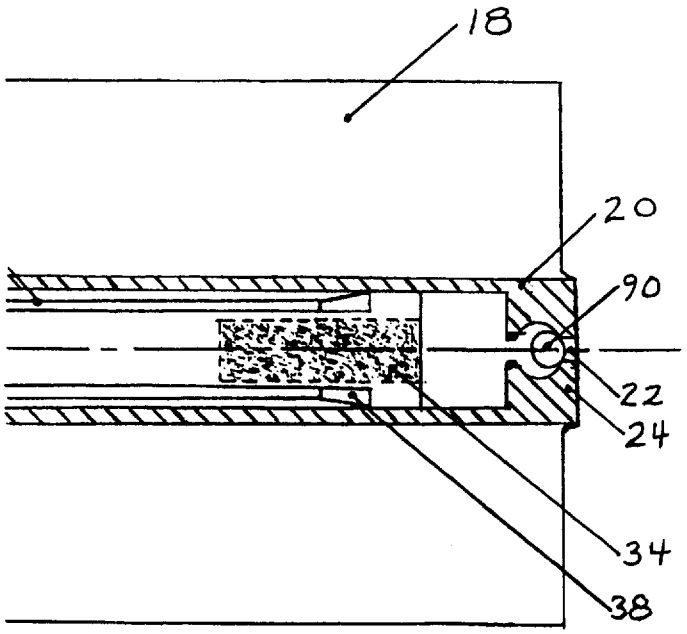
FIG. 6 is a partial longitudinal sectional view of the projectile showing a ball check valve to prevent the escape of entrapped cavity gas.

Furthermore, if desired to retain the entrapped cavity gas within the projectile so as to hasten or insure projectile lengthening, a ball check can be placed at the orifice and within the shaft to prevent the escape of entrapped cavity gas when the cavity pressure exceeds the external ambient pressure. See FIG. 6. Also, other jam and lock devices to secure the deployed shaft may be preferred, such as a crushable impact and jam material in place of the illustrated taper lock.

In a typical application of this invention, the rearward movement of the projectile center-of-pressure obtained through the rearward movement of fins relative to the projectile center-of-gravity allows for projectile stability to be improved or maintained and for increased warhead weight with a reduced fin size. The reduced fin size provides reduced aerodynamic drag, increased velocity, increased effective range, and improved accuracy through reduced tip-off misalignment caused by muzzle blow-by with reverse flow at the tube exit.

For example, projectile fins are used to provide restoring moments necessary for stability and typically contribute 30 to 50 percent of the total projectile aerodynamic drag. The rearward extension of the fins increases the distance between the fin center-of-pressure and the projectile center-of-gravity. Hence, compared to a projectile with a fixed fin configuration, the same fin restoring moment for a rearward slidable fin can be attained by a reduced fin size with reduced projectile aerodynamic drag, since the latter varies approximately with the fin total planform area. Drag reductions of 10 to 25 percent are conceivably attainable with the use of a slidable empennage.

Furthermore, a present constraint on warhead weights on fin-stabilized projectiles arises from the limited empennage restoring moment associated with the short distance between the fin center-of-pressure and the projectile center-of-gravity. A rearward slidable fin capability would allow for greatly increased restoring moments and increased warhead weight. Indeed, a slidable fin projectile could even provide stability for multiple, shaped-charge warheads arranged in tandem along the projectile axis.

Similarly, the rearward movement of the tail section and the accompanying projectile shape change allows for significant changes in the stability characteristics and reduction of aerodynamic drag of spin-stabilized projectiles. Also, the reduced projectile volume in the firing chamber attained by this invention for both fin- and spin-stabilized projectiles allows the additional space to be filled with propellant, resulting in increased muzzle velocity.

The tube pressure activated on and/or off contact between the deflected shaft and boom surfaces and/or projectile elongation can be used to perform a useful function, such as perform as a switch or complete an electrical circuit. As examples, such a pressure activated on and/or off contact can initiate or be part of a safety and arming or timing circuit or device, or initiate or be part of a battery or power supply circuit or device.

OPERATION OF THE INVENTION

As noted above, it is sometimes desirable to lengthen the flight configuration over that of its in-tube transit configuration.

As shown in FIG. 1, the projectile of this invention is a compact assembly when in the tube before launch. The mechanism disclosed here will automatically elongate the projectile upon completion of the launch sequence. When the main propellant charge is ignited in the tube, the combustion gases build up a very high pressure in the tube to propel the projectile out. When this gas pressure builds up, the external pressure on the outer surface of the shaft causes the shaft walls to deflect slightly. Since the clearance between inner surface of the shaft and the outer surface of the boom is very small, (typically 0.001 inch) the shaft deflection clamps the shaft to the boom surface locking the shaft and boom in the position shown in FIG. 1. During the initial burn of the propellant, some of this high pressure gas is trapped in the cavity 34 of the boom 30. The cavity will remain pressurized until the projectile emerges from the launching tube into atmospheric pressure. This external pressure reduction causes the combustion gas trapped in the boom cavity to expand and be discharged out of the orifice 22 in the shaft 20. On exiting the tube, the reduction of the ambient gas pressure acting on the shaft allows the shaft to deflect to its pre-launch position, permitting it to slide on the boom. The reaction of the boom cavity gas on the inside of the vertical end wall 24 of the shaft 20 causes the shaft 20 to be driven to the aft flight position shown in FIG. 3.

A small ball check valve can be provided to retain the entrapped gas in the cavity, if desired. To insure and/or augment activation of the sliding motion of the shaft, an internal source of energy can be provided. As shown in FIG. 4A, a small solid propellant charge 40 can be installed in the cavity of the boom and ignited during the projectile transit in the tube. The combustion gases from this propellant charge will extend the shaft on the boom in the manner described above. Similarly, as shown in FIG. 4B, a capsule or container 42 of compressed gas can be provided in the boom cavity and activated during the projectile transit in the tube to accomplish the projectile extension as described above.

The movement of the shaft at a precise time in the launch sequence makes it possible to use this shaft movement to activate a switch which could control a safety and arming circuit, initiate a battery or other power sources or control other functions associated with the launch procedure.

Thus, to provide the advantages of an elongated fin-stabilized or spin-stabilized projectile it can be seen that there is herein provided a tube launched projectile having a very compact configuration in the launch tube to maximize propellant space in the tube while, at the same time, having an automatic, simple, reliable mechanism for extending the projectile length after launch.

What is claimed is:

1. A tube launched stabilized projectile for launching a payload and having fore and aft portions along a longitudinal axis, said projectile having a mechanism to lengthen the projectile's flight configuration over that of its pre-launch configuration, a combustible propellant within the tube for launching said projectile from the tube by high pressure of combustion gases, said projectile comprising:

a body containing a payload at the fore end of said projectile, said body defining the longitudinal axis;

a boom extending aft from said body along the longitudinal axis and having a plurality of grooves on the outer surface thereof spaced around the periphery of said boom and extending along the longitudinal axis, said boom also having an internal cavity at the aft end;

a hollow shaft surrounding a portion of said boom, said hollow shaft having splines on the shaft's inner surface mating with the grooves of said boom in sliding engagement, said hollow shaft having an aft end closure wall with an orifice communicating with the interior of said hollow shaft;

first locking means for positively locking said hollow shaft onto said boom so as to prevent relative motion between said hollow shaft and said boom at least during part of the transit of said projectile in the tube;

release means for positively releasing locking of said hollow shaft by said first locking means from said boom so as to allow relative motion between said hollow shaft and said boom after exiting the tube and during flight of the projectile;

said first locking means and said release means include spacing between said hollow shaft and said boom over a pre-determined part of their lengths such that said hollow shaft is slightly deflected and locked onto said boom over a pre-determined part of their lengths by the elevated ambient pressure in the tube and said hollow shaft is deflected away from said boom by reduced ambient atmospheric pressure;

second locking means at the aft end of said boom for locking said hollow shaft in the flight configuration with said hollow shaft adjacent the aft end of the boom; and means for changing the projectile from pre-launch to flight configuration when said projectile is propelled out of the tube.

2. The projectile according to claim 1, wherein the means for changing the projectile from a pre-launch configuration to a flight configuration includes:

a source of high pressure gas which causes said locking of said hollow shaft onto said boom and is supplied into said internal cavity of said boom, said gas being maintained at elevated pressure in said internal cavity until said projectile emerges from the tube, said locking means being released to allow said hollow shaft to slide along said boom; and the gases in said internal cavity expanding into the space between said boom and said hollow shaft, a reaction force of said gas against the inside of the end wall of said hollow shaft causing said hollow shaft to slide along said boom and lengthen projectile to the flight configuration, and exit of the said internal cavity gas through said hollow shaft orifice to the ambient atmosphere.

3. The projectile according to claim 2, wherein the source of high pressure gas in said internal cavity is combustion gas from the burning of the propellant in the tube.

4. The projectile according to claim 2, wherein the source of high pressure gas in said cavity is a solid propellant unit ignited in said cavity during the time the projectile is within said tube.

5. The projectile according to claim 2, wherein the source of high pressure gas in said cavity is a compressed gas cylinder released in said cavity during the time the projectile is within said tube.

6. The projectile as defined in claim 2, wherein controlled acceleration of said shaft relative to said boom between the shaft's pre-launch configuration and the shaft's extended flight configuration is achieved by adjusting the sliding friction between the component shaft sections and said boom, by adjustment of said cavity volume, an area opening of said orifice, and by use of a ball check valve.

7. The projectile as defined in claim 2, wherein the spacing between said shaft and said boom is to accommodate elastic deflection of said shaft.

8. The projectile as defined in claim 2, wherein said locking means are intermeshing surfaces such as intermeshing ridges, and/or matching engaging teeth, and/or high friction surfaces.

9. The projectile as defined in claim 1, wherein said second locking means comprises:

an outwardly sloping ramp on the outer surface at the aft end of said boom; and an outwardly sloping ramp on the inner surface of said hollow shaft adjacent the fore end of said hollow shaft, said ramps having dimensions which cause the ramps to lock together when said hollow shaft slides to the flight configuration on said boom.

10. The projectile as defined in claim 9, wherein controlled acceleration of said shaft relative to said boom between the shaft's pre-launch configuration and the shaft's extended flight configuration is achieved by adjusting the sliding friction between the component shaft sections and said boom, by adjustment of said cavity volume, an area opening of said orifice, and by use of a ball check valve.

11. The projectile according to claim 1, wherein said hollow shaft is comprised of unfolding telescoping links.

12. The projectile as defined in claim 1, wherein controlled acceleration of said shaft relative to said boom between the shaft's pre-launch configuration and the shaft's extended flight configuration is achieved by adjusting the sliding friction between component shaft sections and said boom, by adjustment of said cavity volume, an area opening of said orifice, and by use of a ball check valve.

13. The projectile as defined in claim 1, wherein the spacing between said shaft and said boom is to accommodate elastic deflection of said shaft.

14. The projectile as defined in claim 13, wherein said locking means are intermeshing surfaces such as intermeshing ridges, and/or matching engaging teeth, and/or high friction surfaces.

15. The projectile as defined in claim 13, wherein said shaft comprises at least two extendable telescoping links.

16. The projectile as defined in claim 1, wherein said locking means are intermeshing surfaces such as intermeshing ridges, and/or matching engaging teeth, and/or high friction surfaces.

* * * * *